United States Patent [19]

Karikas

[11] 4,254,356

[45] Mar. 3, 1981

[54] INLEAD AND METHOD OF MAKING A DISCHARGE LAMP

[75] Inventor: John J. Karikas, Shelby, Ohio

[73] Assignee: General Electric Company, Schenectady, N.Y.

[21] Appl. No.: 32,168

[22] Filed: Apr. 23, 1979

[51] Int. Cl.[3] ..... H01J 9/32; H01J 61/06; H01J 61/36

[52] U.S. Cl. ..... 313/217; 29/25.16; 174/50.64; 313/220; 313/318; 313/332

[58] Field of Search ..... 313/331, 318, 220, 332, 313/217; 174/50.64; 29/25.16, 25.13 (U.S. only)

[56] References Cited

U.S. PATENT DOCUMENTS

| | | | |
|---|---|---|---|
| 2,667,595 | 1/1954 | Noel et al. . | |
| 2,786,882 | 3/1957 | Krefft | 313/332 X |
| 2,965,698 | 12/1960 | Gottschalk . | |
| 3,151,922 | 10/1964 | Preschel et al. . | |
| 3,419,947 | 1/1969 | Gottschalk . | |
| 3,868,528 | 2/1975 | Lake et al. | 174/50.64 X |
| 4,110,657 | 8/1978 | Sobieski | 174/50.64 X |

FOREIGN PATENT DOCUMENTS

| | | | |
|---|---|---|---|
| 907245 | 6/1945 | France | 174/50.64 |

*Primary Examiner*—Palmer C. Demeo

*Attorney, Agent, or Firm*—Ernest W. Legree; Lawrence R. Kempton; Philip L. Schlamp

[57] ABSTRACT

The inlead for the electrode sealed into a quartz arc tube has a foil portion which is stiffened by reversely folded lateral edges. The folds overlap the tapering region of greater stiffness where the foil portion joins the end portions. In making a discharge lamp, the electrode-inlead assembly is self-centering as a result of making the overall width of the foil portion and its folded edges exceed slightly the internal diameter of the quartz tube or neck. The frictional engagement between the folded edges and the inside wall of the neck retains the assembly in place while the neck is heat-collapsed onto the foil to seal the electrode assembly in place.

13 Claims, 10 Drawing Figures

INLEAD AND METHOD OF MAKING A DISCHARGE LAMP

The invention relates to an inlead for a discharge lamp electrode and to a method of making a lamp. Both are particularly suitable for use with miniature metal vapor discharge lamps wherein accuracy in the length and location of the interelectrode gap is most important.

BACKGROUND OF THE INVENTION

Inleads containing a thin foil portion of a refractory metal such as tungsten or molybdenum have been commonly used for sealing into quartz envelopes to provide current conductors to the electrodes. These metals can withstand the very high temperatures necessary for sealing into quartz. Provided the foil or ribbon portions are sufficiently thin, they will merely go into tension when the bulb cools but will not rupture nor crack the seals. The inlead may be composite comprising a length of foil with a wire welded to each end, or it may be made from a single piece of metal, for instance by rolling a wire between pressure rolls as taught in U.S. Pat. No. 2,667,595—Noel et al., 1954.

The electrode inlead assemblies used in high pressure discharge lamps generally comprise an inlead of the foregoing kind having an electrode structure formed on one end, as by winding a tungsten wire around the shank portion. An arc tube comprises one such assembly sealed into each end of a quartz tube. The common method of sealing has been to stand the electrode inlead assembly up on a spindle, place one end of the quartz tube around it, heat the quartz to softening temperature, and then pinch or press the end of the tube shut between a pair of opposed fast acting jaws. Reference may be made to U.S. Pat. No. 2,965,698—Gottschalk, 1960, for a fuller description of pinch sealing.

The foliated portion of the inlead must be very thin in order to avoid shaling off and remain hermetically bonded to the quartz. Thicknesses greater than 0.0015" may give trouble with leaks and a thickness of 0.0009" at the thickest portion of the foil is typical. The result has been that the inlead is lacking in stiffness and bends so readily that horizontal sealing has been impractical. Vertical pinch-sealing has been the rule. However when an electrode inlead assembly is mounted on a spindle preparatory to sealing, as shown for instance at 6 in FIG. 2 of the Gottschalk patent, it can barely stand vertical and the electrode portion frequently leans and sags over to one side or the other. In conventional vertical pinch sealing, lack of inlead stiffness is not too important; if the electrode should lean over, the forceful movement of the viscous quartz by the pressing jaws snaps the electrodes substantially back into place at pinching. Furthermore, in prior art high pressure metal vapor lamps which generally were rated in excess of 100 watts, the arc gap or distance between the electrode tips would be several centimeters. In such lamps a misplacement of the electrodes in the end by a millimeter or so would have no appreciable effect on the electrical characteristics and performance of the lamp.

In electric lamp manufacture, the arc voltage drop is an important parameter which must be kept constant but it varies proportionally to the length of the interelectrode gap. Accordingly, as the size of lamp and length of gap are reduced, the need for accuracy in gap determination increases in importance. Also the heating of the ends of the arc chamber is strongly influenced by the extent to which the electrodes are inserted and project into the arc chamber. Such heating determines the extent of vaporization of the fill, particularly of the metal halides which tend to condense in the cooler ends. Thus both the length and the location of the inter-electrode gap are important and the need for precision in its determination increases as the size of the lamp is reduced.

In copending application Ser. No. 912,268, filed June 5, 1978 by Cap and Lake, entitled "High Pressure Metal Vapor Discharge Lamps of Improved Efficacy" and which is assigned to the same assignee as the present invention, new lamp designs are disclosed utilizing shaped envelopes with small end seals for reducing end losses. In these new lamps and particularly in the smaller sizes having arc chamber volumes less than 1 cubic centimeter, precision in both the length of the interelectrode gap and its location within the bulb is essential.

SUMMARY OF THE INVENTION

The general object of the invention is to provide a foil type inlead for sealing into vitreous material, particularly quartz, which has improved rigidity and self-centering properties which facilitate accurate location of the electrodes in the arc chamber. A method of making a lamp is sought which facilitates proper centering and axial alignment of the electrodes in a horizontally supported envelope. The inleads must accommodate themselves to envelope necks which are uniform in diameter and large enough for either electrode inlead assembly of the lamp to pass through. After the electrode inlead assemblies have been inserted and accurately located, the inleads must hold them securely in place until seals have been made.

In accordance with my invention, I provide foil type inleads in which the thin foil portion is wider than the inside diameter of the neck into which it will be sealed. The edges of the foil are reversely folded, that is bent in opposite directions out of the medial plane, one up and the other down, to stiffen it. The dimensions are such that the foil edges are bent back and the cross-section tends toward a Z-shape as the inlead is forced into the tubular neck. This causes the electrode-inlead assembly to become centered in the neck and axially aligned upon entering the bulb portion of the envelope. Furthermore, the frictional engagement of the foil in the neck holds the electrode assembly in place while the quartz is heated and shrunk around the electrode and finally collapsed around the foil itself to make the hermetic seal.

DETAILED DESCRIPTION

Figure 1:
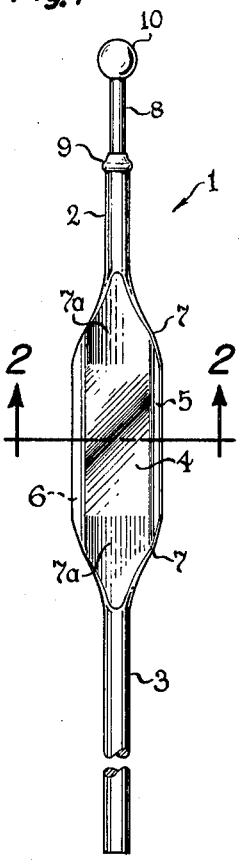
FIGS. 1 and 1*a* are plan and side views respectively of a rolled inlead and electrode assembly embodying the invention.
Figure 1A:
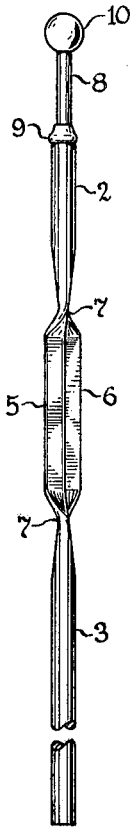
Figure 2:
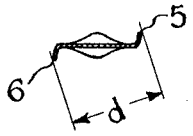
FIG. 2 is a cross section through the inlead of FIG. 1 along lines 22.

Referring to FIGS. 1 and 2, an electrode inlead assembly 1 embodying the invention comprises a one-piece molybdenum wire portion 2, 3 originally of uniform cross section throughout its entire length, for instance circular and 0.016" in diameter. The central portion 4 has been foliated by longitudinal rolling to a thickness of about 0.0009" at the center. A wire size is chosen in respect of the tubular quartz neck in which it is to be sealed which rolls into a foil portion appreciably wider than the inside diameter of the neck. The edges of the foil portion are reversely folded or bent in opposite directions out of the medial plane, that is edge 5 is bent up not quite to a right angle, about 75° as illustrated, and edge 6 is conversely bent down. The folds are started at the points 7 in the tapering region 7*a* of the inlead where the thickness of the foil is not yet down to its ultimate least value. This provides an overlap between the start of the folds and a foil region of intermediate thickness in which the stiffening effect of the folds begins. Beyond the points 7, that is in a direction away from the central portion 4, the inlead is thick enough to support the weight of the electrode without bending. The folds in accordance with the invention increase the stiffness of the inleads to the point where the assembly will not bend from the weight of the electrode even while supported horizontally exclusively from the opposite end.

Figure 3:
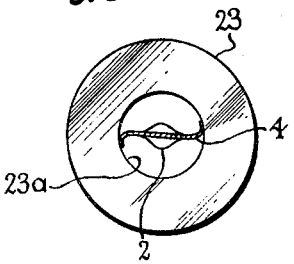
FIG. 3 is an end view through a quartz neck showing the electrode inlead assembly in place.

After the edges have been bent, the overall transverse dimension of the foil, that is the tip-to-tip diagonal d shown in FIG. 2, is slightly greater than the inside diameter of the aperture 23*a* through the quartz neck 23 in which it is to be sealed as shown in FIG. 3. By way of example, a foil of width 0.070" may have a diagonal d of 0.064" after the edges have been folded, and will be suitable for sealing in a quartz neck or tube from 0.052" to 0.056" in internal diameter. The result of this dimensioning and forming is that the folds along the edges of the foil are bent into closer conformance with the curve of the inside wall of the neck and the foil takes a Z-shape as it is forced into the neck. This causes the electrode inlead assembly to become centered in the neck and axially aligned where it enters the end of the bulb. If the folds were not reversed one from the other, the inlead could be stiffened but it would not be self-centering. In addition the frictional engagement of the edges of the foil with the neck wall serves to retain the assembly in place during the interval between the time when the assembly was positioned in the neck and the time when the neck is shrunk around the foil. This is particularly important in automated manufacture in which the lamp envelope is indexed at relatively high speed from station to station while various manufacturing operations are being performed.

Electrode inlead assembly 1 shown in FIG. 1 is intended as an anode and includes a tungsten pin or wire portion 8 attached at 9 to the end of the molybdenum wire portion 2 and terminated at its distal end by a ball 10. The join 9 between molybdenum and tungsten may be effected by a laser butt weld which maintains both parts on the same axis and makes a symmetric structure as taught in U.S. Pat. No. 4,136,298—Hansler, 1979. The ball 10 is readily formed by starting with a tungsten wire 8 longer than necessary and directing a plasma torch on the end to melt it back while it is held upright. Such an anode is suitable for use in a miniature metal halide lamp operating on direct current, for instance a 35-watt lamp such as disclosed in the aforementioned Cap and Lake application. In a d.c. lamp the anode is simply an electron collector but it must have sufficient heat-dissipating capacity to avoid rapid erosion of the tip during operation. The ball 10 performs this function and, by way of example, it may have a diameter of about 25 mils. A Z-cross section foil in accordance with the invention will remain centered in the neck and hold the relatively heavy anode ball or the spudded on cathode substantially on axis even in a lamp which is being supported horizontally during manufacture.

Figure 4:
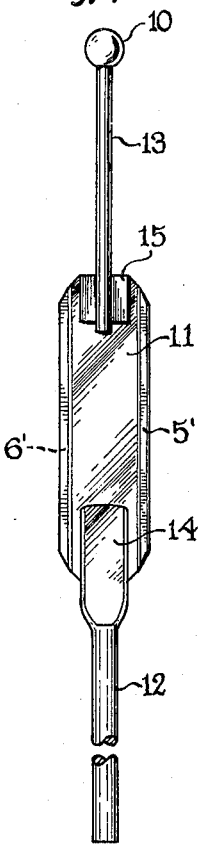
FIG. 4 shows a composite inlead and electrode assembly embodying the invention.

The foliated or flattened portion 4 in the inlead assembly of FIG. 1 has been produced by longitudinal rolling of the wire. Such a portion may also be produced by cross rolling and by swaging or hammering of the original wire. One may also use a composite foil, by way of example comprising, as illustrated in FIG. 4, a cut length of molybdenum foil 11 to one end of which is welded a molybdenum wire 12 and to the other end a tungsten wire 13. The end of wire 12 may be somewhat flattened or spade-shaped at 14 to facilitate welding to the foil. A platinum tab 15 is interposed between foil 11 and tungsten wire 13 to facilitate welding and also serves to stiffen the foil to which it is welded or brazed. In this composite assembly, the edges of the foil 11 are folded in opposite directions out of the medial plane in the fashion previously described, that is edge 5 is bent up not quite at right angles and edge 6 is bent down to a corresponding extent.

In a longitudinally rolled foil as in FIG. 1, there is a gradual taper over the sections 7*a* starting from the full thickness of the wire and going down to the thickness of the central foliated portion 4. In a cross-rolled foil (not shown) a region of gradual taper may be provided by suitable shaping of the rolls. In either case the reversely folded edges 5 and 6 should begin before the foil thickness drops down to its minimum. This will assure an overlap between the region wherein the bent edges provide stiffening and the region where the foil thickness is great enough to support the weight of the electrode without any help. In the composite foil embodiment of FIG. 4, the bent edges 5', 6' are long enough to have overlaps with the weld or braze regions of increased stiffness juxtaposed to the spade terminal 14 or to the platinum tab 15 and thereby achieve sufficient stiffness overall. In a variant of the composite foil which is widely used, the outer lead portion is of molybdenum and the inner end is tapered down into a foil by longitudinal rolling. To the foliated end, a tungsten wire conductor such as 13 in FIG. 4 may be attached by welding or brazing. In such case, the folded edges should at least partly overlap the tapered region at one end and the region of the weld at the other end.

For some applications it is not necessary that the entire inlead electrode assembly be stiff and it may suffice to have stiffness starting at the foil region and going forward to the electrode at the distal end. In such case the folded edges need not be extended into an overlap with a region of greater stiffness at the outer end. My improved leads are of general utility and may be used to advantage in conventional pinch sealing as in the Gottschalk patent. When an electrode-inlead assembly according to the invention is stood on a spindle for pinch sealing, it stands straight and vertical and this assures an improved lamp in which the electrodes are more accurately located.

Figure 8:
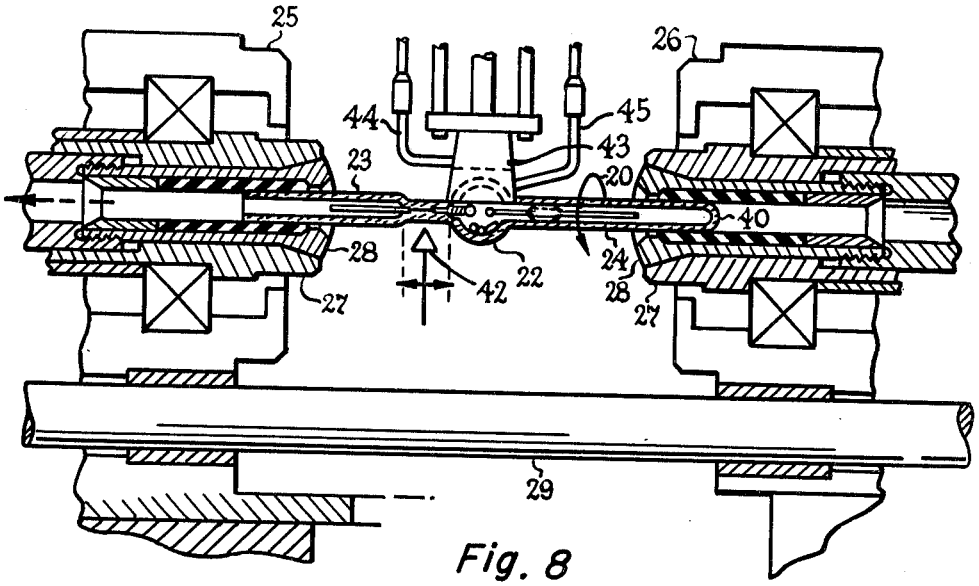
FIG. 8 shows a lamp envelope with electrode inlead assemblies embodying the invention in place while the necks are being shrink sealed.
Figure 9:
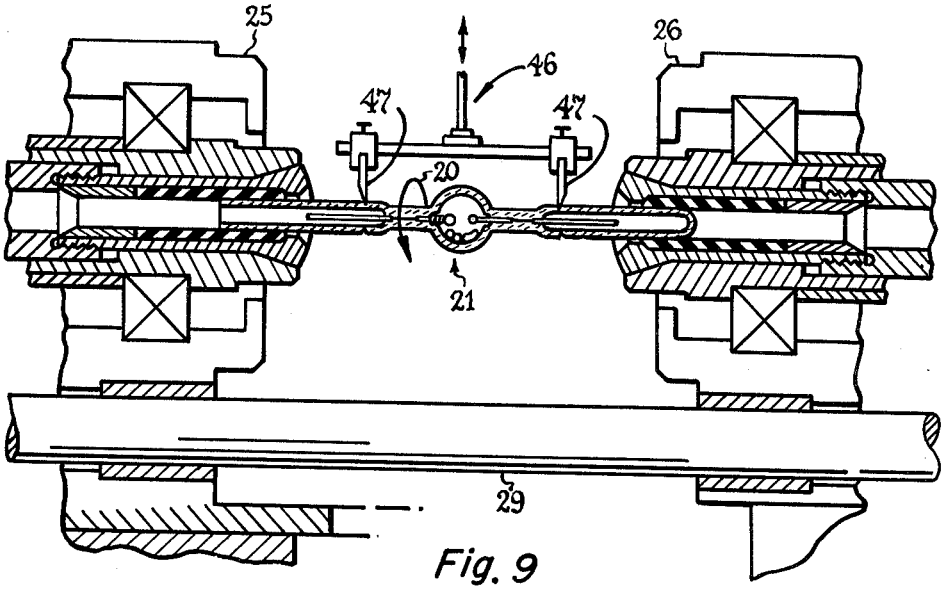
FIG. 9 shows the finished lamp being broken out from the neck fragments supported in the headstock and tailstock of a glass lathe.

The utility and versatility of my improved leads are most noticeable in connection with automated discharge lamp manufacture on equipment which supports the lamp horizontally as shown in FIGS. 5 to 9. The lamp comprises an arc tube or lamp body 21 made from a piece of fused silica or quartz tubing having a hollow bulbous midportion 22 which defines an arc chamber for containing a high pressure discharge. In this particular instance, the arc chamber is generally spherical and has a volume of less than 1 cubic centimeter, but it may be of various shapes such as ellipsoidal or cylindrical and it may vary greatly in size. Joined to and extending in diametrically opposite directions from the mid-portion 22 are two tubular neck portions 23 and 24. Each neck is generally cylindrical and uniform in cross section throughout its length and of course smaller in cross section than the bulbous mid-portion. During the manufacturing operations considered here, the lamp body may be supported horizontally in a glass lathe as shown in FIGS. 8 and 9. The lathe comprises headstock 25 and tail-stock 26 each journaling a chuck 27 accommodating a collet 28 in which the neck portions 23, 24 are received and gripped. A driveshaft 29, partly shown only, couples the headstock and tailstock in known manner to make them rotate in unison. The lamp body is rotated while it is being heated or during sealing as indicated by the curbed arrows 20.

Figures 5, 6, 7:
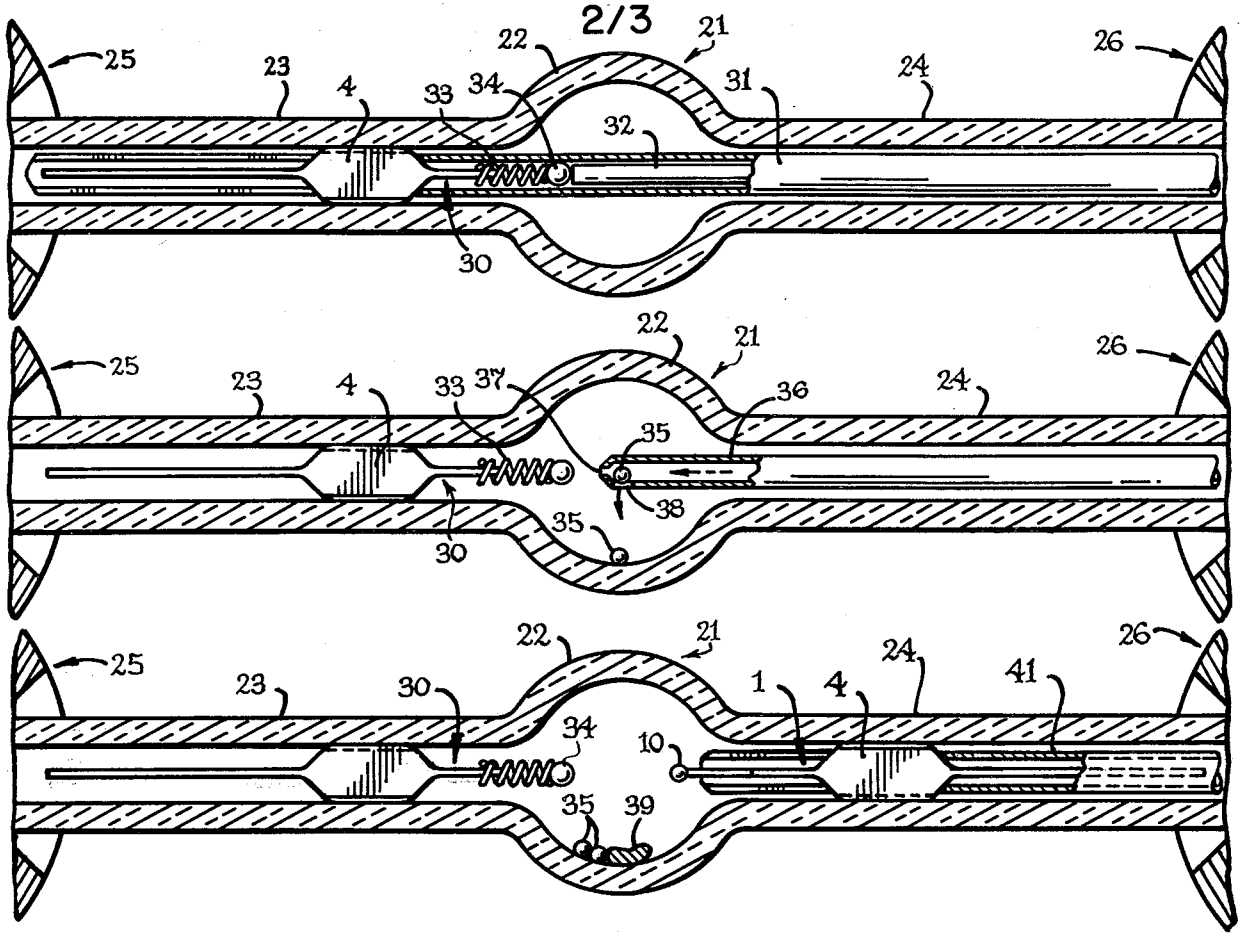
FIG. 5 is an enlarged fragmentary view of a lamp envelope in which an electrode inlead assembly is being inserted through the bulb into the left hand neck.
FIG. 6 is a view similar to FIG. 5 in which metal halide pellets are being inserted into the bulb through the right hand neck.
FIG. 7 is a view similar to FIGS. 5 and 6 in which an electrode inlead assembly is being inserted into the right hand neck.

In manufacturing the lamp, a cathode assembly 30 is transported through the right neck 24 and into the left neck 23 by means of a transporter 31 and a push rod 32 which holds the assembly in place as shown in FIG. 5, until the transporter is withdrawn. The cathode assembly comprises a folded edge inlead 4 as previously described, to the distal end of which is spudded a cathode structure comprising a coil 33 of tungsten wire terminating in a rounded tip 34. Reference may be made to copending U.S. application Ser. No. 973,182, filed Dec. 26, 1978 by Dvorak and Fridrich, "Electrode for High Pressure Metal Vapor Lamp", assigned like this application, for a more complete description of the subject electrode.

In automated lamp making equipment, the glass lathe holding the lamp body would now be indexed into another station, as represented by FIG. 6, at which metal halide pellets 35 are put into the bulb. This may be accomplished by inserting a tubular needle 36 through the right hand neck 24, stopping the needle when its tip 37 is near the center of the bulb. The needle communicates with a low pressure source of dry inert gas whose flow expels the pellets through the downwardly opening port 38 near the end of the needle. Following release of the halide pellets 35, the needle 36 is withdrawn, the glass lathe indexed to another station, and a globule of mercury 39 is released into the bulb by means of another needle similar to the needle 36 previously described.

The glass lathe is then indexed to yet another station represented by FIG. 7 where an anode assembly 1 corresponding to that illustrated in FIG. 1 is positioned in the right neck 24 by means of a transporter 41 and a push rod (not shown) corresponding generally to those used for the insertion of the cathode assembly 30. Meanwhile dry argon has been flushed through the bulb both of whose necks have been open. The tailstock 26 may now be opened and withdrawn to the right and the right neck 24 heated to seal it off at 40 as shown in FIG. 8.

The glass lathe is again indexed and the right neck 24 may now be gripped anew in collet 28 of the tailstock 26. While the bulb is rotating in the glass lathe, the cathode inlead assembly 30 is hermetically sealed into the neck 23 by heating the quartz and reducing the internal pressure to cause the quartz to collapse around the foil portion 4 of the inlead. This may be done for example by a laser, schematically represented at 42, which traverses along an appropriate length of the neck to cause the quartz to collapse as illustrated in FIG. 8. At the same time the bulb portion 22 is cooled by advancing a shroud 43 to partially surround it. The shroud contains a sponge which engages the bulb and which is kept wet by water supplied by tube 44 while aspirator tube 45 removes excess water. Thereafter the anode assembly 1 is hermetically sealed into neck 24 in the same fashion. Finally the lathe is indexed into the station illustrated in FIG. 9 where a head 46 carrying a pair of scoring tools 47 is advanced into an operative position adjacent the lamp body. The tools 47 are located to score the end portions of the necks 23 and 24 beyond the sealing regions of the inlead foils so that the end portions subsequently may be broken away to expose the inleads.

The use of the folded edge inleads according to my invention allows the electrode inlead assemblies to be transported through the necks of the lamp body and to remain firmly in place after having once been positioned. The inleads are self-centering which allows the initial positioning to be precise. The accurate gap determination which is achieved thereby is maintained throughout the subsequent indexes of the glass lathe and lamp body from station to station. The frictional engagement is such that no movement occurs notwithstanding the rotation of the lamp body during the heating and during the shrinking of the necks upon the foils. My invention thus makes possible the high speed mass production of miniature metal vapor discharge lamps with the accuracy in inter-electrode gap determination and the precision in electrode placement necessary for satisfactory lamp performance.

What I claim as new and desire to secure by Letters Patent of the United States is:

1. An electrode-inlead assembly for sealing into an envelope of high temperature vitreous material comprising a longitudinally extending thin refractory metal foil portion joined to a thicker conductor supporting an electrode at its distal end, said foil portion being stiffened by reversely folded lateral edges which overlap the region of greater stiffness where the thicker conductor joins the foil portion.

2. An assembly as in claim 1 wherein the thicker conductor tapers down in thickness to that of the foil portion and said folded edges overlap part of the tapered region.

3. An assembly as in claim 1 wherein the thicker conductor is welded to the foil portion and additional metal is attached to the foil portion about the region of the weld and wherein the folded edges overlap said region.

4. An assembly as in claim 1 wherein the foil portion is joined to a thicker conductor at both ends, and said folded edges overlap the regions of greater stiffness at both ends.

5. An assembly as in claim 1 which is made of one piece of refractory metal wire by rolling a mid-portion down to a thickness where it is no longer self-supporting and wherein the folded edges extend out to where the thickness is adequate to support the electrode.

6. An electric discharge lamp comprising a sealed vitreous envelope having a bulb portion and a neck portion and containing an ionizable filling, a pair of electrode inlead assemblies sealed into said envelope with the electrodes projecting into the bulb portion, the inlead in at least one of said assemblies being a conductor comprising a longitudinally extending thin refractory metal foil portion joined to a thicker conductor at the distal end to which an electrode is attached, said foil portion being stiffened by reversely folded lateral edges which overlap the region of greater stiffness where the thicker conductor joins the foil portion, the vitreous material of said neck portion being collapsed about and hermetically sealed to said foil portion.

7. A lamp as in claim 6 wherein the envelope has a pair of tubular neck portions extending in diametrically opposite directions from the bulb portion, and wherein there is sealed within each neck portion one of said electrode-inlead assemblies in which the foil portion is stiffened by reversely folded lateral edges.

8. A lamp as in claim 6 wherein the inlead comprises a one piece conductor in which wire portions at the ends are tapered down to the thickness of a central foliated portion and wherein the reversely folded edges extend along the foliated portion and overlap part of the tapered end regions.

9. A lamp as in claim 6 wherein the inlead is a composite comprising a thin foil portion welded to a wire portion and including additional metal which increases the stiffness in the region of the weld, and wherein the reversely folded edges extending along the foil portion overlap at least part of said weld region of increased stiffness.

10. A method of making a discharge lamp to achieve centering of the electrode within a bulb which comprises the steps of:

providing a vitreous envelope having a bulbous portion with a tubular neck portion extending therefrom, providing an electrode inlead assembly comprising an inlead having an electrode attached to one end and wherein the inlead comprises a longitudinally extending thin foil portion stiffened by reversely folded lateral edges and proportioned in overall width to exceed slightly the internal diameter of the neck portion, inserting the electrode-inlead assembly into the neck portion and allowing the frictional engagement of the foil portion with the neck walls to center the assembly, and then heat-collapsing the neck portion onto the foil portion to seal the electrode in place.

11. The method of claim 10 wherein the envelope has two neck portions extending in diametrically opposite directions from the bulbous portion, and wherein an electrode-inlead assembly is inserted and sealed in each neck portion.

12. A method of making a discharge lamp to achieve precise determination of the electrode gap within a bulb which comprises the steps of:

providing a vitreous envelope having a bulbous portion with tubular neck portions projecting therefrom, said neck portions being substantially uniform in internal diameter, providing electrode inlead assemblies comprising an inlead having an electrode attached to one end and wherein each inlead comprises a longitudinally extending thin foil portion stiffened by reversely folded lateral edges and proportioned in overall width to exceed slightly the internal diameter of the neck for which it is intended, inserting the electrode-inlead assemblies into their respective necks and positioning them precisely so that the electrode tips penetrate the bulbous portion and define the desired electrode gap, the frictional engagement of the foil portions with the neck walls serving to center the assembly and to retain it securely in place after it has been positioned, and then heat-collapsing the neck portions onto the foil portions to seal the electrodes in place.

13. The method of claim 12 wherein the neck portions project in diametrically opposite directions, and wherein one electrode-inlead assembly is transported electrode-last through one neck portion into the other neck portion, and the other electrode-inlead assembly is transported electrode-first into the one neck portion.

* * * * *